US006494139B1

(12) United States Patent
Powell

(10) Patent No.: US 6,494,139 B1
(45) Date of Patent: Dec. 17, 2002

(54) HOLE BORING CHARGE ASSEMBLY

(75) Inventor: Kevin M. Powell, Kent (GB)

(73) Assignee: Qinetiq Limited, Farnborough (GB)

( * ) Notice: Subject to any disclaimer, the term of this patent is extended or adjusted under 35 U.S.C. 154(b) by 0 days.

(21) Appl. No.: 07/466,712

(22) Filed: Jan. 9, 1990

(51) Int. Cl.[7] ..... F42D 3/02; F42B 1/02; E21B 7/00

(52) U.S. Cl. ..... 102/310; 175/4.6

(58) Field of Search ..... 102/306, 307, 102/310, 475, 476, 701; 175/4.6

(56) References Cited

U.S. PATENT DOCUMENTS

| | | | | | |
|---|---|---|---|---|---|
| 2,587,243 | A | * | 2/1952 | Sweetman | 102/307 |
| 2,616,370 | A | * | 11/1952 | Foster | 102/307 |
| 2,928,658 | A | * | 3/1960 | Miner | 102/310 |
| 2,976,940 | A | * | 3/1961 | Surbatovich | 102/310 |
| 2,984,307 | A | * | 5/1961 | Barnes | 102/307 |
| 3,043,379 | A | * | 7/1962 | Porter et al. | 102/310 |
| 3,347,164 | A | * | 10/1967 | Baks et al. | 102/310 |
| 3,348,482 | A | * | 10/1967 | Keener et al. | 102/310 |
| 3,732,830 | A | * | 5/1973 | Lindstedt | 109/36 |
| 3,847,080 | A | | 11/1974 | Eckels | 102/311 |
| 3,982,486 | A | * | 9/1976 | Eckels | 102/310 |
| 4,069,760 | A | * | 1/1978 | Eckels | 175/4.6 |
| 4,273,050 | A | * | 6/1981 | Brown | 102/310 |
| 4,493,260 | A | * | 1/1985 | Foster | 102/307 |
| 4,955,939 | A | * | 9/1990 | Petrousky et al. | 102/306 |

FOREIGN PATENT DOCUMENTS

| | | |
|---|---|---|
| FR | 2566893 | 1/1986 |
| GB | 1152173 | 5/1969 |
| GB | 1448363 | 9/1976 |
| GB | 1465259 | 2/1977 |

* cited by examiner

*Primary Examiner*—Charles T. Jordan
(74) *Attorney, Agent, or Firm*—Nixon & Vanderhye P.C.

(57) ABSTRACT

A hole boring charge assembly suitable for explosively forming a wide borehole in a concrete target consists of a detonatable array of at least three hollow charges (12) having recessed, lined forward faces (14) facing towards the target in the same general direction as a fore-and-aft line of target penetration. Simultaneous detonation of the charges (12) produce individual jet penetrators derived from the charge liners (16) which penetrate the target and together produce a wide multi-sided borehole therein suitable for the subsequent emplacement of a blasting charge. The charges (12) may be focussed forward of the array to produce a single, coalesced penetrator which is capable of producing a wide, tapered, approximately axisymmetric hole in concrete.

17 Claims, 5 Drawing Sheets

HOLE BORING CHARGE ASSEMBLY

BACKGROUND OF THE INVENTION

1. Field of the Invention

This invention relates to a hole boring charge assembly and in particular to an assembly capable of penetrating concrete targets.

2. Discussion of Prior Art

It is known that the attack, disruption, and destruction of fixed targets such as airfield runways, shelters, bunkers, bridges, roadways, railway marshalling yards and dockyards may be effected by first emplacing and then detonating relatively small quantities of high explosive within or under the target. The materials of construction of these targets are typically strong in compression and yet weak in tension, as exemplified by most forms of concrete. Such emplacement exploits both the inherent confining effect of the target material on the charge of emplaced explosive and the tensile weakness of the target material, and furthermore enhances the transmission of energy f rom the detonated explosive into the immediately adjacent confining medium and onwards into the outlying and underlying target structure. Where the target consists of a wall or a roof of a shelter or bunker, the emplaced charge of explosive may be replaced by a more complex blasting and/or fragmenting device which may include hollow charge and/or secondary pyrophoric effects.

One known technique of rapid implantation of explosive charges into fixed targets is to first breach the surface of the target with a hole-boring charge of explosive before driving the blasting (secondary) charge of explosive into or through the hole so formed. This technique has the advantage that it may be used in both the manual demolition of fixed targets, in which the hole boring and secondary charges will usually be brought separately and sequentially to the target, and in the mechanical attack of such structures by remotely delivered munition systems such as bombs, missiles and shells which incorporate both types of charge in the delivered system. Furthermore, this technique of hole boring is also applicable to the rapid provision of access ways through fixed massive structures for personnel and equipment in the event of accident, emergency, or during the course of urban warfare.

The main requirement for a hole boring charge as applied to fixed targets is that it should be capable of producing a breach in the target of sufficient width and depth of penetration to permit subsequent emplacement of the secondary, blasting charge at a position which will cause enhanced damage to the structure once the secondary charge is detonated. The hole may be large enough to permit complete emplacement of the secondary charge within or even under the target. Alternatively, it may only be large enough to cause a remotely delivered secondary charge to lodge partly in the hole, but this at least has the advantage that it prevents ricochet of the secondary charge away from the target before detonation. In a remotely-delivered munition system in particular, the hole-boring charge should also preferably be of relatively small size and weight in comparison with that of the secondary charge because it is for the most part the latter charge which performs the task of destroying the target.

These requirements have in the past been met in part by the use of a hollow explosive charge having a conical concavity in one face lined with a non-explosive liner. When the charge is detonated, the liner collapses upon its axis and is formed into a high velocity jet which upon impact with the target produces a hole. However, such known hollow charges fail to fulfil all the requirements for a variety of reasons. Hollow charges with concavities having acutely-angled apexes generally collapse the liner into long, narrow, high speed jets. These are capable of penetrating both massive structures and armour to considerable depths. However the resulting holes bored in the target material tend to be narrow and tapered and so are not suitable for the subsequent emplacement of a secondary charge therein. The diameter of the hole can be increased by increasing the diameter of the hollow charge, but the corresponding increase in weight of the hollow charge is undesirable and furthermore the increase in target penetration in targets of finite thickness such as concrete walls, roads and runways may cause the secondary charge to be emplaced beyond the depth at which it can cause maximum damage to that target. Wider holes are also produced for the same calibre of charge using shallower angled, lined concavities (ie concavities with large-angled apexes, of apex angles generally greater than 80°, especially greater than 100°) which generally form the liners into projectiles which tend towards lower velocity, non-jet penetrators. However, the shorter lengths and lower kinetic energies of these penetrators result in a significant reduction in performance especially against concrete targets, necessitating an undesirably large charge mass in order to excavate a hole of sufficient volume to permit emplacement of the secondary charge to an optimum depth.

SUMMARY OF THE INVENTION

It is one object of the present invention to provide a hole boring charge assembly which overcomes the disadvantages associated with the use of a hollow explosive charge.

According to the present invention there is provided a hole boring charge assembly for penetrating a target, comprising a detonatable array of at least three hollow charges of explosive supported laterally of one another in a detonatable array, each charge in the array having a recessed forward face and a nonexplosive liner lining the recessed forward face, detonation means for detonating each charge thereby to project a penetrator, derived from the liner, forwards along a line of trajectory, the charges being geometrically arranged in the array such that the lines of trajectory extend toward the target in the same general direction as a fore-and-aft line of target penetration and detonation initiating means for initiating detonation of the charges in the array in a temporal relationship with respect to one another such that the penetrators are projected towards the target concurrently.

The effect of the linearly projected penetrators impacting concurrently on a target has been found to vary depending on whether they penetrate the target separately or as one. However, the present arrangement of hollow charges has in general been found to produce a hole in a target material of a volume which is significantly larger than that which could be produced by a single hollow charge of the same overall mass.

The mode of failure of the concrete and subsequent formation of the borehole is complex but the following which does not in any way limit the scope of the invention provides an explanation of the possible mechanics involved.

The initial effect of three or more hollow charge penetrators impacting separately and concurrently on a target is, as would be expected, to bore a number of narrow, deep holes into the target equal to the number of hollow charges detonated. The collision of the penetrators with the target material produces intense shock waves which radiate outwards from the holes as they are formed. The strength of the shockwaves radiating from each penetrating jet is sufficiently large to cause material immediately adjacent the holes produced to fail in compression. In the case of impact by a single hollow charge jet, shock wave intensity decreases with distance of travel into the target, and damage is limited to the immediate vicinity of the hole. However, when three or more jets impact concurrently on the target, the transmitted shock waves from adjacent jets are reflected upon collision, and in the process of collision subject the target material to intense compression thus extending the region of failure to encompass the material bounded by the holes. This material may be ejected from the surface of the target upon its subsequent relaxation immediately following compression, an effect which may be assisted by gases generated during penetration by the jets, to leave behind a single and relatively wide resultant borehole encompassing the narrow holes initially formed by the individual penetrators and extending for a substantial proportion of the depth of those narrow holes. Thus, the present array of hollow charges exploits the efficient hole boring and rapid energy dissipation characteristics of explosively-formed penetrators, especially jet penetrators, but at the same time produces a much larger hole suitable for access or for subsequent emplacement of a blasting or cratering charge.

For this effect to be produced, it is not essential that the hollow charges should be arranged to produce penetrators which are projected along parallel pathways, although the arrangement should be such that the penetrators preferably produce a non-linear array of impact points on the surface of the target so that the lines of trajectory encompass a finite volume of target material. By appropriate geometric arrangement of the individual charges within the array, the penetrators may diverge or converge slightly, though preferably at an angle of not more than 30°, more preferably not more than 20°, to a line parallel to a line of target penetration. Divergent penetrators will produce a shorter, wider resultant hole because the relaxation effect will diminish more rapidly with increasing distance into the target, whereas slightly convergent penetrators will tend to produce a deeper and slightly tapered hole.

If the hollow charges of the array are geometrically arranged so that the penetrators converge and meet at a focal point before or, more preferably, soon after penetrating the target, it has been found that a single coalesced penetrator will form which surprisingly has little tendency to diverge from its resultant trajectory. The resultant penetrator tends to retain approximately the same energy density as the separate penetrators from which it is formed, so that a significant depth of target penetration in both high and low tensile strength materials is maintained. However the hole produced in target materials such as concrete is found to be very much wider than would have been expected from that produced by a single hollow charge of similar linear geometry and equivalent mass. Furthermore, the resultant, coalesced penetrator dissipates its energy rapidly when it comes into contact with softer material such as sand, soil, clay or gravel which may underlie a ground target such as an airfield runway or roadway, leaving a bulbous cavity below the target which is ideally shaped and positioned for the subsequent emplacement of a blasting or cratering charge.

It has been found that a coalesced penetrator of optimum penetration efficiency and hole boring characteristics is produced by so arranging the hollow charges that the penetrators converge at a distance from the base of each charge recess (ie from the forward face) of between two and twenty times, preferably between two and ten times, most preferably between three and seven times, the diameter of the liner. A distance of a minimum of two diameters is required adequately to form the collapsed liners into penetrators, whereas at a distance of greater than seven diameters the penetrators tend to break up and become increasingly particulate, and at a distance of greater than 10 diameters, it becomes increasingly difficult to focus the charges in the array accurately. The most preferred upper limit of distance is therefore at the point at which the onset of particulation occurs for each single charge. In any event, unless a large and yet relatively shallow hole is required (for example in a concrete wall for access only), the penetrators will collide at angles of preferably not greater than 90°, more preferably not greater than 60°, most preferably not greater than 30° to one another in order to prevent a significant reduction in kinetic energy transmission in the direction of target penetration.

Since it will be understood that each of the individual penetrators do not by themselves contribute significantly to the width of the resultant hole produced by either of the effects described above in relation to focussed and non-focussed penetrators, it is therefore advantageous to provide a design of hollow charge which produces maximum depth rather than maximum width of penetration. Hollow charge and liner combinations which produce very long jet penetrators are therefore preferred.

Hitherto, such combinations have been found undersirable in hole boring charge assemblies for attacking concrete targets because singly such charges normally produce deep, narrow, tapered holes of little use for the emplacement of a secondary charge. In order to maximise the kinetic energies that can be attained by such jets, the non-explosive liners are preferably of relatively low density ductile materials having densities of less than 5 gm $cm^{-3}$. Aluminium and alloys thereof are especially preferred, although plastics (such as polyethylene) and metal-loaded plastics may also be used, for example plastics loaded with up to 50% by weight of particulate aluminium or particulate aluminium alloy. Such low density materials can be formed into jet penetrators from much deeper recesses than traditional, high density shaped charge liner materials such as copper, so that within certain limits much higher penetrator velocities hence kinetic energies are possible with the former. The charges themselves are preferably axisymmetric with conical recesses which are commonly referred to as shaped charges, and using these low density liners the apex angle of the correspondingly conical liners is preferably from 15° to 70°, more preferably from 20° to 55°, most preferably from 25° to 50 °.

The array preferably contains up to 6 charges and is normally provided in a symmetrical form with the charges preferably equispaced about a line of target penetration and preferably lying in a plane normal to that line. For a non-focussed array of charges (which term also encompasses slightly convergent arrays), the most preferred number of charges is four (especially if the charges are positioned in a substantially square array) since a triangular array of only three charges significantly reduces the diameter of the hole produced. For a focussed array of charges, in which the charges are arranged such that the penetrators meet preferably before they particulate, the most preferred number of charges in the array is three, this being the minimum number required to produce a reasonably axisymmetrical, coalesced penetrator. In symmetrical arrangements the charges will normally be arranged to be detonated simultaneously, although in other arrangements a rapid succession of detonations may be advantageous. A relatively closely-spaced array is preferred especially when the charges are non-focussed, the centres of gravity of adjacent charges being located within a pitch circle diameter of preferably less than 6 charge widths, more preferably less than 4 charge widths.

Each hollow charge will generally be detonated from the rear and may be provided with its own, rearward detonator.

However, in order to provide a reliable means of detonating the charges, the initiating means may comprise a common detonator from which stems a track of explosive one to each hollow charge. The tracks can be made of different lengths to provide a apid succession of charge detonations or, more preferably, can be made substantially the same length as each other to provide substantially simultaneous detonations. The tracks of explosive preferably comprise detonating cord.

When the hollow charges are in a focussed configuration, at least two of the liners may be of different materials, especially of different materials which interreact exothermically when the penetrators coalesce. This can produce a significant pressure increase within the target during penetration, which can enhance the hole boring effect and can also produce cratering of the target without necessitating the subsequent emplacement of a follow-through charge. An example of three different liner materials which when coalesced may together produce this effect are zirconium, titanium, and iron. In this particular case, the liner may comprise a hollow cone with an apex angle of between 20° and 120° or a hemispherical cap, the latter being commonly referred to as a Miznay Schardin dish.

BRIEF DESCRIPTION OF THE DRAWINGS

Embodiments of hole boring charge assemblies in accordance with the present invention will now be described by way of example only with reference to the accompanying drawings in which.

DETAILED DESCRIPTION OF THE PREFERRED EMBODIMENTS

Figure 1:
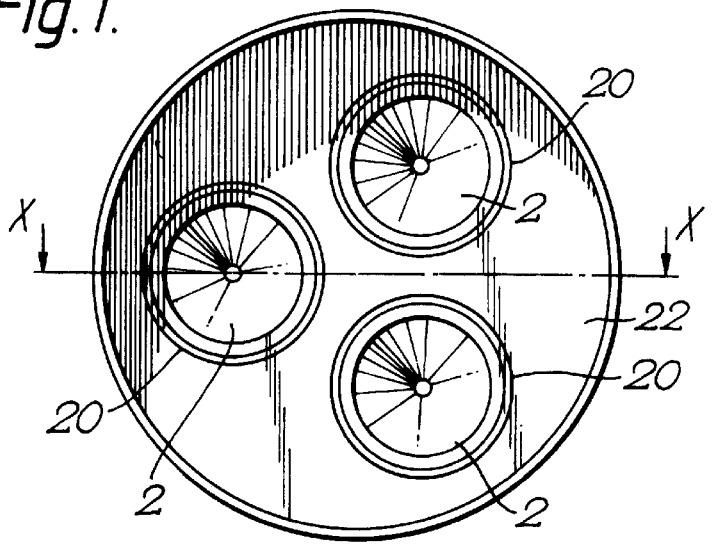
FIG. 1 is a view of the underside of a first embodiment of this invention having a parallel, symmetrical array of three hole-boring charges.
Figure 2:
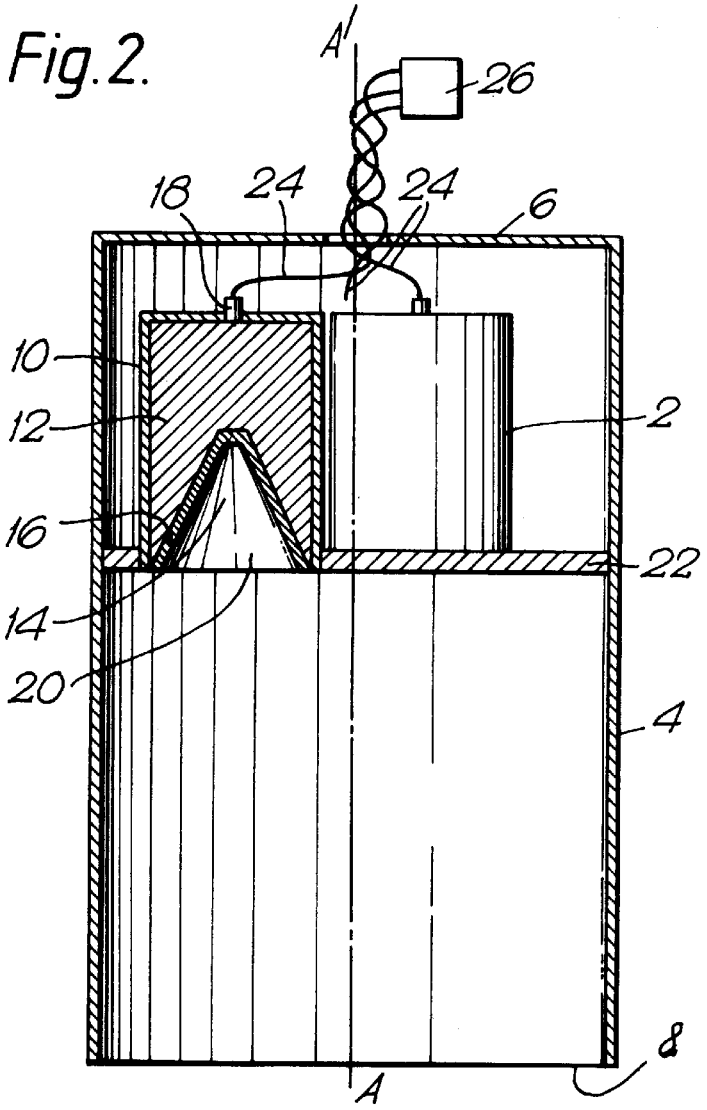
FIG. 2 is a sectional view taken along line XX of FIG. 1, FIG. 3 provides a schematic representation of the effect of the three hole-boring charges configured in the arrangement shown in FIGS. 1 and 2 on a target.

Referring to the first embodiment of this invention illustrated in FIGS. 1 and 2, a hole boring charge assembly comprises three shaped charge munitions 2 mounted about a fore-and-aft axis AA' of a cylindrical canister 4 having a closed rearward end 6 and an open forward end 8. Each shaped charge munition 2 consists of a cylindrical casing 10 open at its forward end and containing a hole-boring shaped charge 12 of high explosive having a right-conical recess 14 in its forward face. The recess 14 is lined with a liner 16 of non-explosive material, for example aluminium. The casing 10, charge 12 and liner 16 of each munition 2 are symmetrically disposed about an axis of symmetry. A detonator 18 is axisymmetrically located at the rear of the charge 12. The axes of symmetry of the munitions 2 are configured in the arrangement illustrated in FIG. 2 parallel to the axis AA'.

The munitions 2 are mounted equidistantly from one another and from the fore-and-aft axis AA', within circular openings 20 in a flat, circular support plate 22 lying transverse the axis AA' and attached to the inside of the canister 4. The liners 16 each face the open forward end 8 of the canister 4. The support plate 22 is positioned within the canister 4 so as to provide an optimum standoff distance for the munitions 2 between the plate 22 and the open end 8 of the canister which, in use, will normally rest against a target to be penetrated. Electric firing leads 24 extends from each detonator 18 to a common trigger switch 26 located outside the canister 4 which, when operated, initiates all three hole-boring charges 12 simultaneously. Initiation of the charges 12 collapses the three liners 16 forwardly into high speed penetrators which are each projected simultaneously along the axes of symmetry of the charges towards the target to be penetrated.

Figure 3:
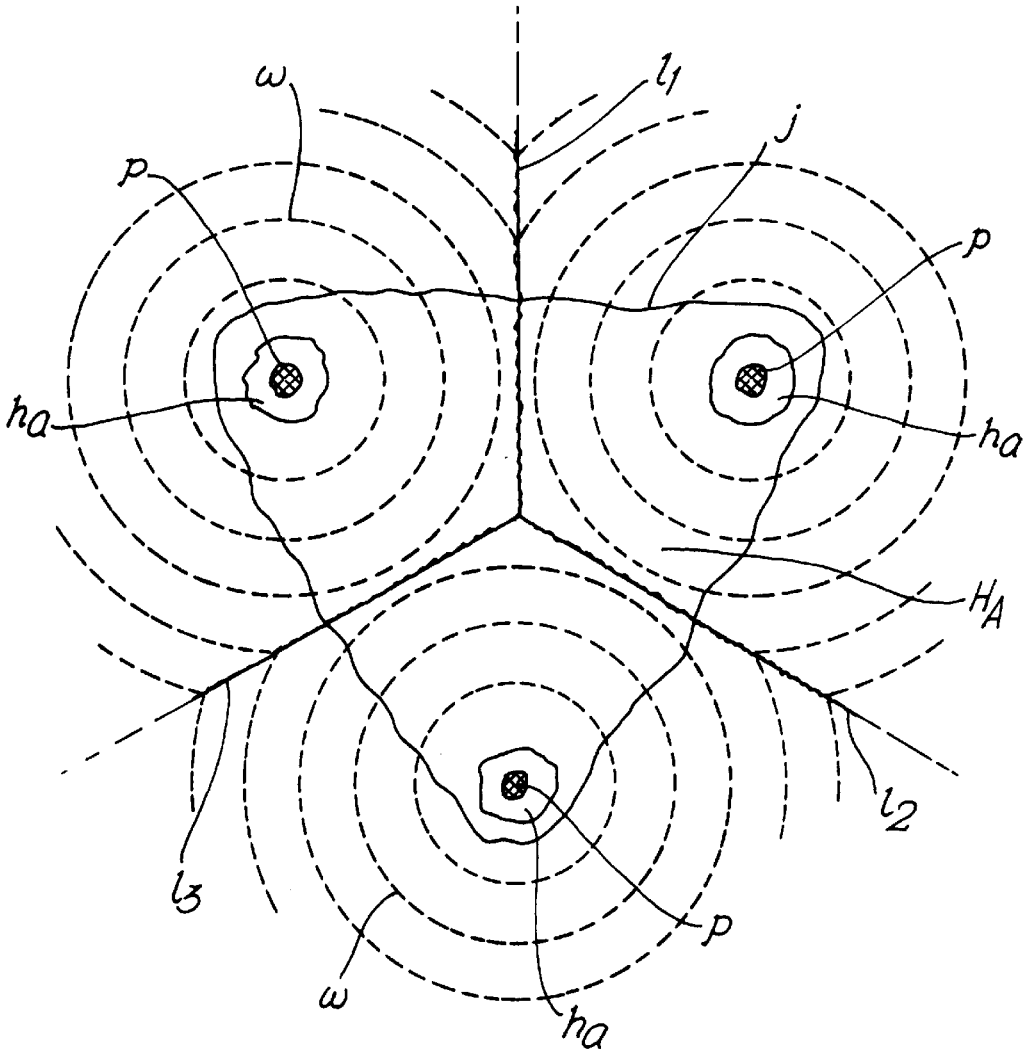

The effect of the penetrators on a hard, brittle target material such as concrete is shown in FIG. 3. FIG. 3 is a schematic representation of a cross section taken through the target material laterally of the line of flight of the penetrators at the instant of their passage through the target. The penetrators (p) bore narrow, inwardly-tapered holes ($h_a$) into the target material. The process of penetration generates shock waves (w) in the target material which radiate outwards from the holes ($h_a$). Since they are generated concurrently, the shock waves derived from adjacent penetrators collide along planes (represented end-on by lines $\mathbf{1}_1$, $\mathbf{1}_2$ and $\mathbf{1}_3$) which extend into the target material and run parallel to and between the paths of the penetrators. Collision and reflection of the shock waves creates regions of intense compression along these planes, causing material in the vicinity of these regions to fail. Upon subsequent relaxation following compression, a large volume of target material surrounding the holes ($h_a$) is ruptured. Gases generated during penetration contribute to the ejection of ruptured material outwards from the surface of the target to leave behind a large hole ($H_A$) of triangular cross-section bounded by the jagged line (j). The position of the munitions 2 in the assembly approximately defines the corner locations hence lateral shape and dimensions of the hole ($H_A$). The hole ($H_A$) extends for most of the depth of the holes ($h_a$) initially bored by the individual penetrators (p).

Figure 4:
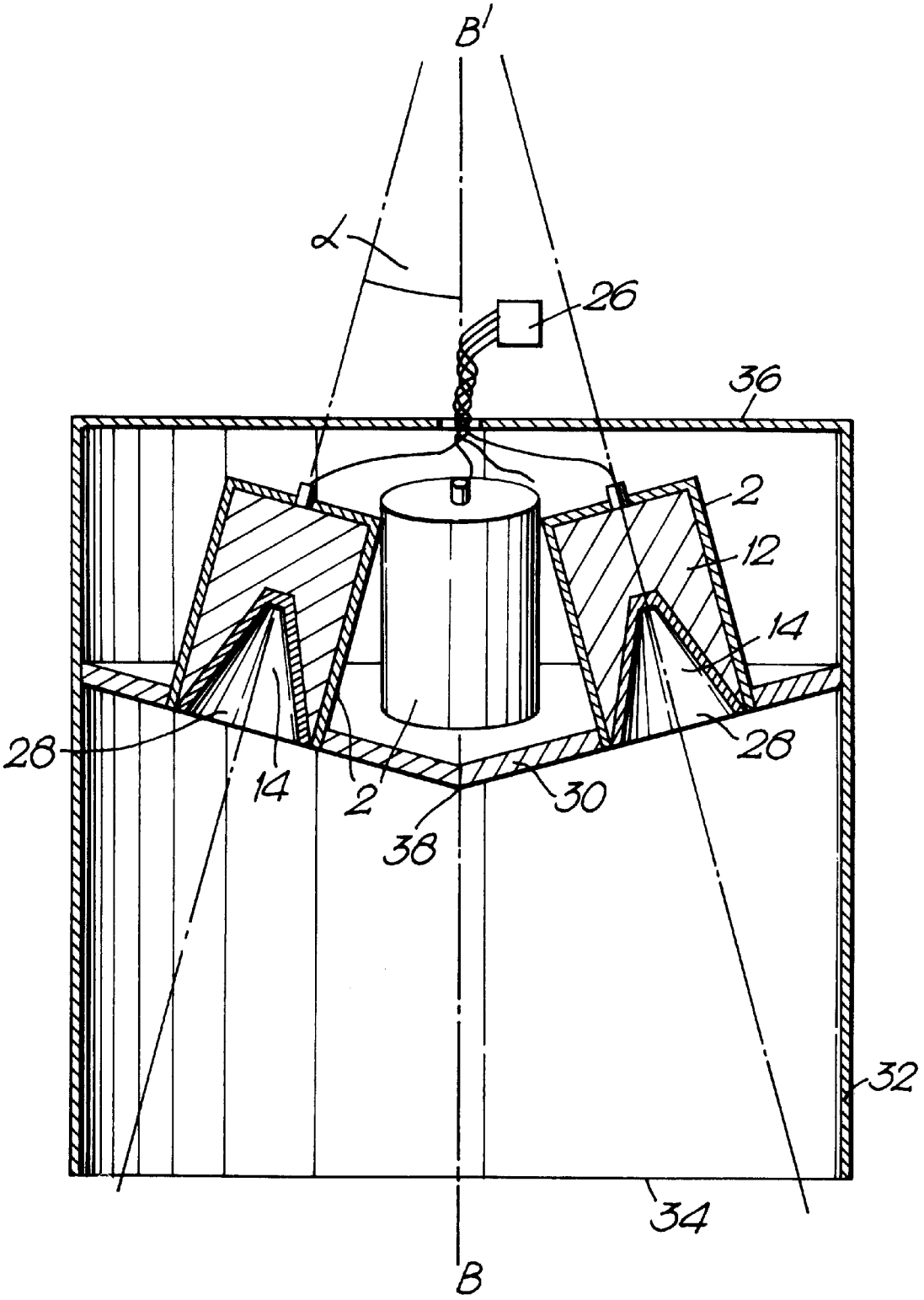
FIG. 4 is a sectional view similar to that of FIG. 2 of a second embodiment of this invention having a divergent, symmetrical array of four hole-boring charges.

A similar hole boring effect to that described above with reference to FIG. 3 is produced by the second embodiment of this invention, illustrated in FIG. 4. In this second embodiment, four shaped charge munitions 2 are mounted within equidistantly-spaced openings 28 in a first, right-conical support plate 30 located transversely within a second cylindrical canister 32 having a fore-and-aft axis BB', an open forward end 34 and a closed rearward end 36. The apex 38 of the support plate 30 is obtusely angled and points towards the open end 34 of this canister 32 to create a divergent alignment of the munitions 2 with respect to the axis BB'. The axes of symmetry of the shaped charge munitions 2 therefore diverge from one another forwardly of the support plate 30, so that simultaneous detonation of the charges 12 produce penetrators which each diverge from the axis BB' at an acute angle of preferably not more than 20° to strike the target at separate locations and at a distance from the charges 12 defined by the stand-off distance provided by the length of canister 32 forward of the support plate 30. A hole is produced in the target which is generally wider but shorter than that produced by a parallel array of shaped charges 12 as exemplified by the first embodiment of this invention, since in comparison with the first embodiment, the divergence of the penetrators from the munitions 2 causes a more rapid reduction of shockwave collision intensity with increasing depth into the target.

It will be understood by those skilled in the art that a similar effect will also be produced by a slightly convergent array of at least three shaped charge munitions 2, provided always that the penetrators strike the target at separate locations and preferably do not meet for a distance of less than ten charge diameters from the base of each conical recess 14. A slightly convergent array will tend to produce a hole in a concrete target which is deeper, narrower, and slightly tapered in comparison with that produced by a parallel array.

Figure 5:
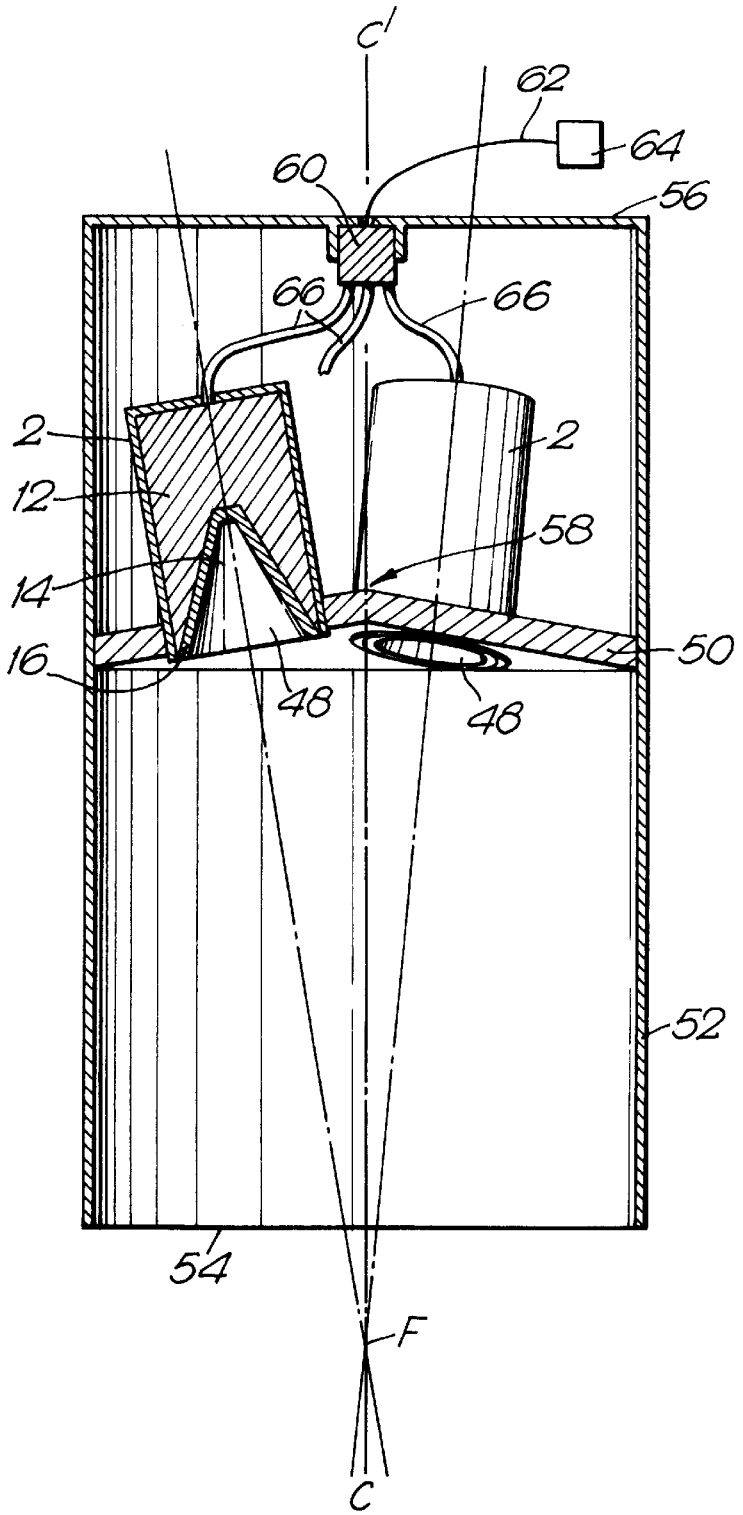
FIG. 5 is a sectional view of a third embodiment having a focussed, symmetrical array of three hole-boring charges, and FIGS. 6 and 7 provide comparative schematic views of the effect of detonation of a focussed array of three hole-boring charges as illustrated in FIG. 5 on a target (FIG. 6) with the effect on the same target of a single one of the hole boring charges (FIG. 7).

In FIG. 5 there is illustrated a sectional view similar to that of FIG. 2 of a third embodiment of this invention, in which the three shaped charge munitions 2 are mounted within equispaced circular openings 48 in a second conical support plate 50 such that their axes of symmetry are focussed on one another at a focal point F located at a distance of less than 10 charge diameters from the base of each recess 14. The support plate 50 is mounted transversely within a third, cylindrical canister 52 having an open forward end 54, a closed rearward end 56, and a fore-and-aft axis CC' which passes through the focal point F and equidistantly between the munitions 2. The conical support plate 50 is mounted with its apex 58 facing rearwards to allow for the correct alignment with respect to the axis CC' of the shaped charges 2 mounted in the openings 48. The location of the support plate 50 within the canister 52 is such that forward of the support plate, the cannister provides adequate stand-off distance to ensure the focal point F is located just beyond the open forward end 54.

The three munitions 2 do not include separate detonators. Instead, inside the closed rearward end 56 is axially housed a common detonator 60. An electric firing lead 62 extends from the detonator through the rearward end 56 to a trigger switch 64. Three flexible detonating cords 66 stem from the detonator 60 and extend one to the rear of each munition 2. Each cord 66 enters its respective munition 2 along the axis of symmetry of the munition. The three cords 66 are of equal length to enable the transmission of detonation waves from the detonator 60 which arrive at all three munitions 2 simultaneously.

In use, the open forward end 54 is presented to the surface of the target and the three charges 12 are detonated simultaneously by the detonator 60 through the detonating cords 66, from a signal transmitted by the trigger switch 64 to the detonator 60 through the lead 62. The penetrators produced by the collapsed liners 16 meet at the focal point F just below the surface of the target and coalesce into a single jet penetrator which then further penetrates the target.

Figure 6:
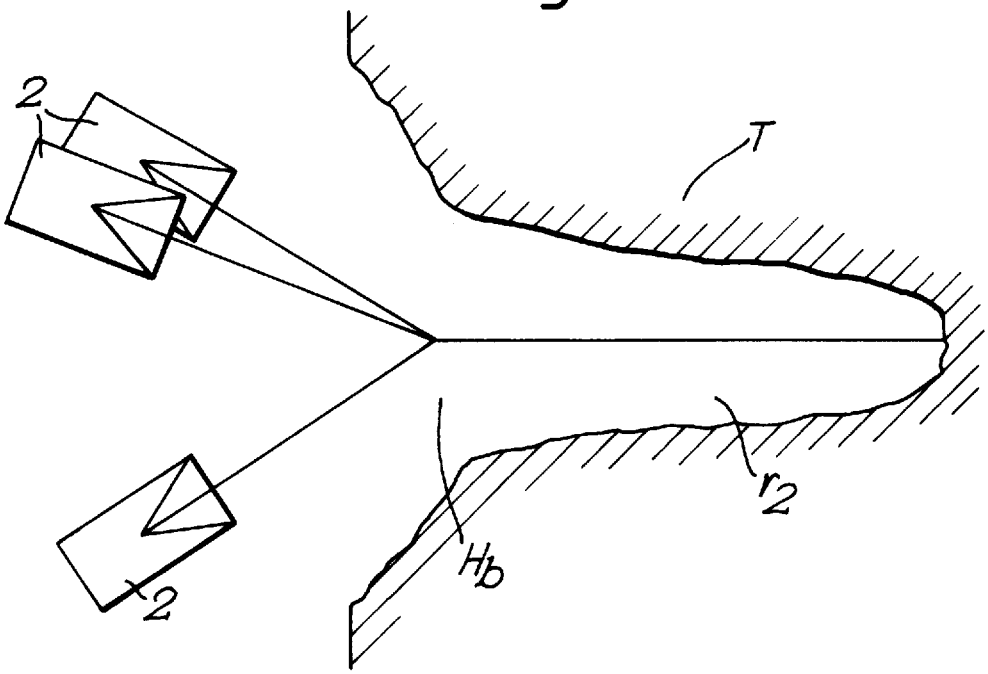
Figure 7:
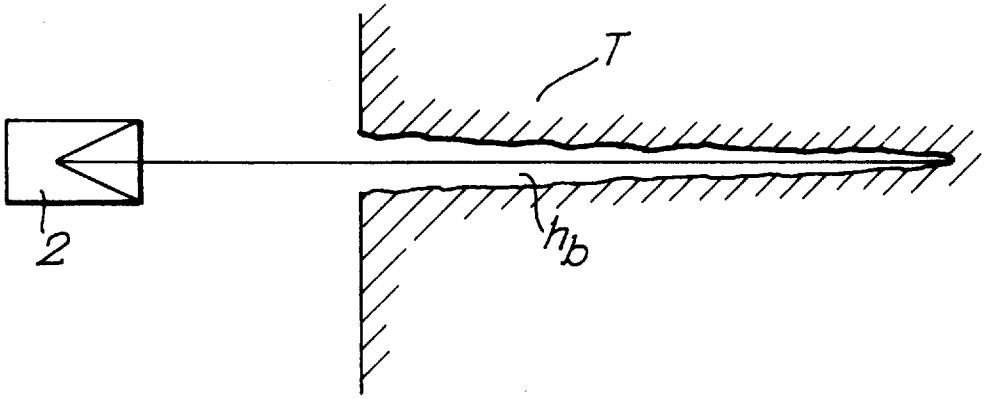

The effect of the detonated array of three focussed munitions 2 on a target is shown schematically in FIG. 6, producing a funnel-shaped approximately axisymmetric hole ($H_B$) in a concrete target (T) of considerable depth and width. The deep, tapered inner region ($r_2$) of the hole is produced by the penetrators once they have coalesced within the target T. By contrast, the effect on the same target of a single one of the shaped charge munitions 2 is shown in FIG. 7, producing a tapered hole ($h_b$) which even at its widest point is considerably narrower than that produced by the coalesced penetrator.

It has been found that, against a 0.3 m thick concrete vehicle-supporting ground target (eg airfield runway), a triple focussed array of identical shaped charges each having a diameter of 85 mm and conical aluminium liner of 45° apex angle and arranged on a pitch circle diameter of 200 mm with their axes inclined at 8°56' to the axis CC' of FIG. 5, such that the forward faces of the charges are located at a distance of 425 mm above the surface of the target and the axes are focussed at a point 200 mm below the surface, will produce a bore-hole of similar throat dimension and penetration depth as a 180 mm diameter unitary shaped charge with an 85° conical aluminium liner and an all up mass of twice that of the triple array.

It has further been found that against the same target, a triple parallel array of identical shaped charges arranged in accordance with the embodiment illustrated in FIGS. 1 and 2 on a pitch circle diameter of 155 m, each charge having a diameter of 85 mm and a conical aluminium liner of 30° apex angle and having its forward face located at a distance of 425 mm above the surface of the target, will produce a bore-hole of similar throat dimension and penetration length as a 180 mm diameter unitary shaped charge with an 85° conical aluminium liner and an all-up mass of 1.8 times that of the triple array.

What is claimed is:

1. Hole boring charge assembly for penetrating a target, said assembly comprising:

at least three hollow charges of explosive in a detonatable array, each charge in the array including a recessed forward face having an apex angle of between 15° and 55° and a non-explosive liner of a material having a density of less than 5 $gmcm^{-3}$ lining the recessed forward face;

detonation means for detonating each charge thereby projecting a penetrator, derived from the liner, forwards along a line of trajectory, the charges being geometrically arranged in the array such that the lines of trajectory extend towards said target in the same general direction as a fore-and-aft line of target penetration; and detonation initiating means for initiating detonation of the charges in the array in a temporal relationship with respect to one another such that the penetrators are projected towards the target concurrently.

2. Assembly according to claim 1 wherein the hollow charges in the array are all substantially identical.

3. Assembly according to claim 1 wherein the hollow charges in the array lie in a plane normal to a fore-and-aft line of target penetration.

4. Assembly according to claim 1 wherein the detonation means includes means for detonating all the hollow charges substantially simultaneously.

5. Assembly according to claim 1 wherein the centre of gravity of each hollow charge in the detonatable array is located within a pitch circle diameter of less than 6 charge widths.

6. Assembly according to claim 1 wherein the hollow charges are geometrically supported in the array such that the lines of trajectory independently lie at angles of from 0° to 30° to lines parallel to a line of target penetration.

7. Assembly according to claim 1 wherein the material is selected from the group consisting of aluminium, alloys of aluminium, plastics, and plastics loaded with up to 50% by weight of particulate aluminium or particulate aluminium alloy.

8. Assembly according to claim 1 wherein the apex angle is from 25° to 50°.

9. Assembly according to claim 1 wherein the hollow charges are geometrically supported in the array such that the lines of trajectory are substantially parallel or converge towards one another forward of the array.

10. Assembly according to claim 9 wherein the lines of trajectory are substantially focussed at a focal point.

11. Assembly according to claim 10 wherein the focal point is located at a distance of from two to twenty liner diameters from each of the forward faces.

12. Assembly according to claim 10 wherein the focal point is substantially the same distance from each hollow charge, and the detonation means includes means for detonating all the hollow charges substantially simultaneously.

13. Assembly according to claim 10 wherein the assembly includes spacer means for spacing the hollow charges in the array prior to detonation at a distance from the target which is less than the distance between the hollow charges and the focal point.

14. Assembly according to claim 10 wherein at least two of the liners are of different materials which react together exothermically when the penetrators meet at the focal point.

15. Assembly according to claim 14 wherein three of the liners are of different materials which react together exothermically when the penetrators meet at the focal point.

16. Hole boring charge assembly for penetrating a target, comprising a detonatable array of at least three hollow charges of explosive supported laterally of one another in a detonatable array, each charge in the array having a recessed forward face and a non-explosive liner lining the recessed forward face, detonation means for detonating each charge thereby to project a penetrator, derived from the liner, forwards along a line of trajectory, the charges being geometrically arranged in the array such that the lines of trajectory extend towards said target in the same general direction as a fore-and-aft line of target penetration, and detonation initiating means for initiating detonation of the charges in the array in a temporal relationship with respect to one another such that the penetrators are projected towards the target concurrently wherein the lines of trajectory are substantially focussed at a focal point and at least two of the liners are of different materials which react together exothermically when the penetrators meet at said focal point.

17. Assembly according to claim 16 wherein three of the liners are of different materials which react together exothermically when the penetrators meet at said focal point.

* * * * *